United States Patent [19]

Yakimicki

[11] 4,378,071

[45] Mar. 29, 1983

[54] CLAMP-ON GRAB RAIL FOR DOORS

[76] Inventor: Elizabeth A. Yakimicki, 420 Mill Rd., Apt. 509, Etobicoke, Ontario, Canada, M9C 1Z1

[21] Appl. No.: 211,731

[22] Filed: Dec. 1, 1980

[30] Foreign Application Priority Data

Nov. 30, 1979 [CA] Canada ..... 341039

[51] Int. Cl.[3] ..... A47H 1/08

[52] U.S. Cl. ..... 211/105.4; 49/70

[58] Field of Search ..... 49/70, 460; 211/76, 211/86, 105.1, 105.3, 105.4, 123

[56] References Cited

U.S. PATENT DOCUMENTS

| | | | |
|---|---|---|---|
| 914,876 | 3/1909 | Phinney | 211/105.4 |
| 2,151,223 | 3/1939 | Nayman, Sr. | 211/105.4 |
| 2,270,796 | 1/1942 | Haugey . | |
| 2,637,446 | 5/1953 | Spangler . | |
| 2,925,916 | 2/1960 | Pollock | 211/86 |
| 3,414,909 | 12/1968 | Provi et al. | 4/185 |
| 3,414,910 | 12/1968 | Provi et al. . | |
| 4,045,842 | 9/1977 | Theriault . | |

*Primary Examiner*—Kenneth Downey

*Attorney, Agent, or Firm*—Ridout & Maybee

[57] ABSTRACT

A grab rail adapted to be detachably mounted across the face of a door comprises an elongated body consisting of a pair of telescopically adjustable members, the body providing at its opposite ends a pair of offset bracket portions for engaging the opposite vertical edges of a door. One of the telescopically adjustable members provides a handle which extends horizontally when the grab rail is mounted on the door. A screw-threaded coupling is provided for adjusting the length of the body by moving one of the members longitudinally with respect to the other, thereby to bring the bracket portions into clamping engagement with the door edges.

8 Claims, 4 Drawing Figures

FIG. 1
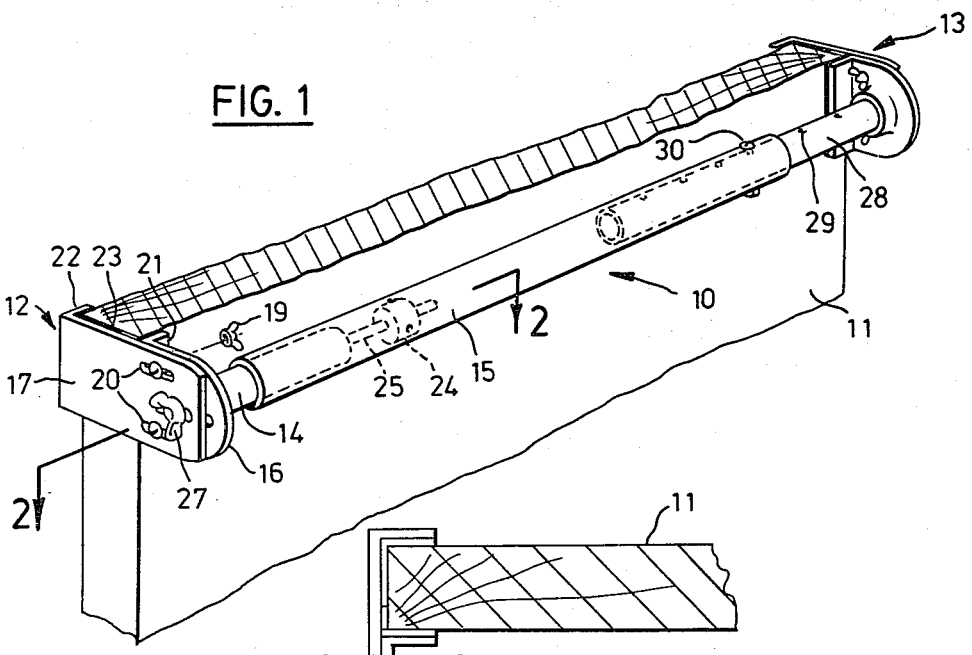
FIG. 2
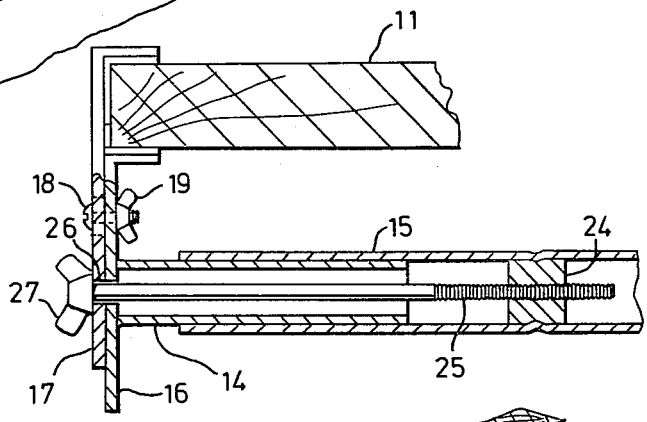
FIG. 3
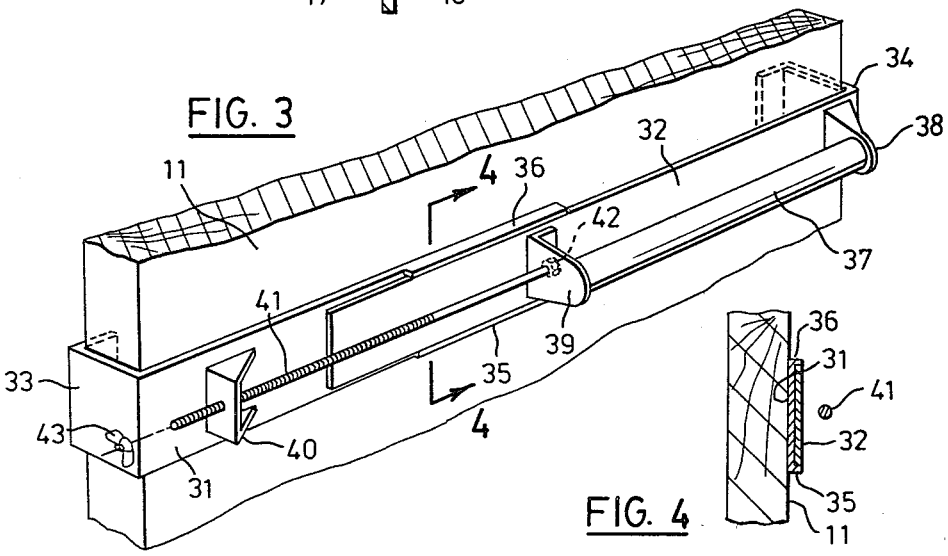
FIG. 4

CLAMP-ON GRAB RAIL FOR DOORS

This invention relates to grab rails of a type intended to be used primarily to afford a steady support which can be grasped by an infirm person. It is desirable that such a grab rail, when used indoors, should be easy to mount on an interior fixture, such as an interior door, readily detachable, readily adjustable, and above all rigidly mountable so that the user will have confidence in the support.

A grab rail in accordance with the present invention is adapted to be detachably mounted horizontally across the face of a door, and comprises an elongated body consisting of a pair of telescopically adjustable members constrained to move longitudinally with respect to one another, one of the members providing a rigid handle portion, each member providing at its end a bracket portion offset from the axis of the body, the bracket portions providing a pair of opposed clamping faces engageable with the respective vertical edges of the door, and means for adjusting the length of the body to bring the opposed clamping faces of the bracket portions into clamping engagement with the door edges.

In one embodiment of the invention the elongated body consists of a pair of telescopically adjustable tubular members nesting one within the other, the outer tubular member providing a rigid handle portion. In another embodiment of the invention the telescopically adjustable members are formed by flat bars, one of which provides a guide engaging the longitudinal edges of the other to maintain the bars in alignment, the rigid handle portion being constituted by a separate horizontal grab bar mounted longitudinally on the front face on one of said members.

In order that the invention may be readily understood, two embodiments thereof will now be described, by way of example, with reference to the accompanying drawings in which:

FIG. 1 is a perspective view of a grab rail constructed in accordance with the invention, the grab rail being mounted on a door;

FIG. 2 is a sectional plan on line 2—2 in FIG. 1, showing a detail of the construction;

FIG. 3 is a perspective view similar to FIG. 1 showing a second grab rail in accordance with the invention; and FIG. 4 is a section on line 4—4 in FIG. 3 showing a section on line 4—4 in FIG. 3 showing a detail of the construction.

Referring to FIGS. 1 and 2, the grab rail includes an elongated body 10 which is shown mounted horizontally across the face of a door 11. At the ends of the body are a pair of offset bracket portions 12, 13 which extend rearwardly from the body perpendicularly to its axis, the bracket portions 12, 13 providing a pair of opposed clamping faces which are brought into clamping engagement with the opposite vertical edges of the door 11. The body 10 basically comprises a pair of telescopically adjustable tubular members 14, 15 nesting one within the other, the outer tubular member 15 constituting a rigid handle portion which may be grasped by the user. The telescopic adjustment of the tubular members will be described subsequently.

Each of the bracket portions 12, 13 consists of a first bracket plate 16 which is welded to the end of the tubular member 14, and a second bracket plate 17 which is clamped to it by bolts 18 and wing nuts 19, the bolts 18 extending through elongated holes such as 20 which permit individual adjustment of the bracket portions to accommodate different door thicknesses. As illustrated in the drawings, the bracket plates 16, 17 have inturned vertical end flanges, or return flanges 21, 22 which straddle opposite sides of the door so as to bear against them when the bracket portion engages the edge of the door. To prevent the metal bracket plates from scratching the door, it is desirable to provide a soft lining 23 on the portions of the bracket plate surfaces which come into contact with the wood of the door.

For adjusting the length of the body 10, a collar 24 is located at a suitable position within the tubular member 15 the collar having a central threaded bore through which a screw threaded coupling rod 25 extends in threaded engagement with it. The coupling rod 25 extends axially through the tubular members and through a pair of aligned holes 26 in the bracket plates 16, 17 a wing nut 27 being welded to the end of the rod. One of the holes 26 is elongated, of course, to permit relative adjustment of the bracket plates, By rotating the wing nut 27 in the appropriate direction, the telescoping tubular members 14, 15 are moved longitudinally relative to one another thereby to adjust length of the body 10. This provides fine adjustment of length, but the illustrated embodiment also provides for stepwise coarse adjustment. For this purpose the outer tubular member 15 has a tubular extension in the form of a tubular component 28 nesting within it, the bracket portion 13 being mounted at the end of this component. The tubular component 28 has a series of spaced pairs of diametrically opposed holes 29 which can be brought selectively into registration with a pair of diametrically opposed holes in the tubular member 15, the components 15 and 28 then being secured in assembled relationship at the adjusted length by means of a bolt 30 which is inserted into the registering holes.

To mount the grab rail on a door, the tubular components 15 and 28 are positioned with respect to one another at the adjusted length, a little greater than the width of the door, and the device is positioned on the door so that the opposed clamping faces of the bracket portions 12, 13 engage the opposite edges of the door, the bracket plates 17 being adjusted as may be necessary. The wing nut 27 is then rotated to draw the tubular members 14, 15 together, and so bring the bracket portions 12, 13 into firm clamping engagement with the door edges.

In the alternative embodiment illustrated in FIGS. 3 and 4, the elongated body is constituted by a pair of telescopically adjustable flat bars 31, 32. The ends of the bars are formed with rearwardly extending flanges 33, 34 as shown, which constitute the bracket portions for engaging the vertical edges of the door 11, these flanges terminating in return flanges which bear against the reverse face of the door. The member 31 has a pair of forwardly projecting, longitudinally extending flanges 35, 36 which engage the longitudinal edges of the bar 32 and so provide a rectilinear guide channel for constraining the relative movement of the bars 31, 32 in the longitudinal direction. The handle portion in this case is formed by a horizontal grab bar 37, which is rigidly supported at its ends by bracket members 38, 39 mounted securely, for example by welding, on the front face of the bar 32. A further bracket member 40 is welded onto the front face of the bar 31, and has a central hole through which a screw-threaded coupling rod 41 extends. The rod extends through an aligned hole in the bracket member 39 and is retained by a captive nut 42. To permit longitudinal adjustment of the telescopically adjustable members 31, 32 for adjusting the length of the body, a wing nut 43 is provided, this nut engaging the rod 41 and, when the device is clamped across the front face of the door as shown, abuts against the bracket member 40 which serves as a stop.

What I claim is:

1. A grab rail adapted to be detachably mounted across one face of a door, comprising:

an elongated body consisting of a pair of telescopically adjustable members constrained to move longitudinally with respect to one another, one said member providing a rigidly mounted handle portion, each member providing at its end a bracket portion offset from the axis of the body, said bracket portions providing a pair of opposed clamping faces engageable with the respective vertical edges of the door, and each said bracket portion terminating in a return flange adapted to bear against the reverse face of the door, and means for adjusting the length of the body to bring said opposed clamping faces into clamping engagement with the door edges.

2. A grab rail according to claim 1, wherein said bracket portions extend parallel to one another in a direction perpendicular to the length of the body, each bracket portion comprising a first bracket plate terminating in said return flange and a second bracket plate terminating in a second return flange adapted to bear against said one face of the door, the bracket portions being individually adjustable to accommodate different door thicknesses.

3. A grab rail according to claim 1, wherein said means for adjusting the length of the body comprises a screw-threaded coupling rod extending longitudinally between respective securement means on said members, one said securement means including a threaded coupling engageable with the rod.

4. A grab rail according to claim 3, wherein one of the telescopic members is itself adjustable stepwise in length, the member consisting of a pair of telescopically adjustable components with means for securing said components in assembled relationship at the adjusted length.

5. A grab rail adapted to be detachably mounted across the face of a door, comprising:

an elongated body consisting of a pair of telescopically adjustable tubular members nesting one within the other, the outer tubular member providing a rigidly mounted handle portion, each tubular member providing at its end a bracket portion offset from the axis of the body, said bracket portions providing a pair of opposed clamping faces engageable with the respective vertical edges of the door, and each said bracket portion terminating in a return flange adapted to bear against the reverse face of the door, and means for adjusting the length of the body to bring said opposed clamping faces into clamping engagement with the door edges, said length adjusting means comprising a screw-threaded coupling rod extending longitudinally between first securement means located within one said tubular member and second securement means located at the end of the other tubular member, said second securement means including a threaded coupling engageable with the rod.

6. A grab rail according to claim 5, wherein said bracket portions extend parallel to one another in a direction perpendicular to the length of the body, each bracket portion comprising a first bracket plate terminating in said return flange and a second bracket plate terminating in a second return flange adapted to bear against the reverse face of the door, the bracket portions being individually adjustable to accommodate different door thicknesses.

7. A grab rail according to claim 5, wherein said one tubular member is itself adjustable stepwise in length, the member consisting of a pair of telescopically adjustable components with means for securing said components in assembled relationship at the adjusted length.

8. A grab rail according to claim 1, wherein said telescopically adjustable members are formed by flat bars each providing a front face and a rear face, one bar providing guide means engaging the longitudinal edges of the other bar, the rigidly mounted handle portion being constituted by a grab bar mounted longitudinally on the front face of said other bar, and said bracket portions extending rearwardly from the respective ends of the bars to engage the vertical edges of a door on which the grab rail is to be mounted.

* * * * *